US006863064B2

(12) United States Patent
Lyons et al.

(10) Patent No.: US 6,863,064 B2
(45) **Date of Patent: *Mar. 8, 2005**

(54) FRAMED FIREPLACE AND METHOD

(75) Inventors: David C. Lyons, Red Wing, MN (US); Dominique R. Pitman, Prior Lake, MN (US); Alfredo Schroeder, Welch, MN (US)

(73) Assignee: HON Technology Inc., Muscatine, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/101,264

(22) Filed: Mar. 18, 2002

(65) Prior Publication Data

US 2002/0096171 A1 Jul. 25, 2002

Related U.S. Application Data

(63) Continuation of application No. 09/354,495, filed on Jul. 16, 1999, now Pat. No. 6,374,822.

(51) Int. Cl.[7] ..... F24B 1/195
(52) U.S. Cl. ..... 126/500; 126/85 B
(58) Field of Search ..... 126/85 B, 500, 126/512, 521, 515, 520, 544, 86

(56) References Cited

U.S. PATENT DOCUMENTS

| | | | | | |
|---|---|---|---|---|---|
| 661,500 | A | * | 11/1900 | Dames | 126/500 |
| 803,938 | A | * | 11/1905 | Thompson | 126/520 |
| 1,670,223 | A | * | 5/1928 | Van Kirk | 126/500 |
| 1,699,241 | A | * | 1/1929 | Johnson | 126/500 |
| 3,100,734 | A | * | 8/1963 | Rex et al. | 162/152 |
| 3,301,249 | A | * | 1/1967 | Hendricks | 126/500 |
| 3,970,067 | A | * | 7/1976 | Vaughn | 126/520 |
| 4,041,929 | A | * | 8/1977 | Cooksey | 126/500 |
| 4,301,784 | A | * | 11/1981 | Dinwiddie | 126/531 |
| 4,305,374 | A | * | 12/1981 | Taylor | 126/500 |
| 4,385,622 | A | * | 5/1983 | Tidwell | 126/528 |
| 4,700,687 | A | * | 10/1987 | Bailey et al. | 126/500 |
| 4,793,322 | A | * | 12/1988 | Shimek et al. | 126/512 |
| 4,913,131 | A | * | 4/1990 | Petersen | 126/544 |
| 5,505,191 | A | * | 4/1996 | Brown | 126/500 |
| 5,647,340 | A | * | 7/1997 | Shimek et al. | 126/85 B |
| 5,915,374 | A | * | 6/1999 | Susany | 126/500 |
| 5,941,237 | A | * | 8/1999 | Shimek et al. | 126/512 |
| 5,996,575 | A | * | 12/1999 | Shimek et al. | 126/512 |
| 6,374,822 | B1 | * | 4/2002 | Lyons et al. | 126/512 |

FOREIGN PATENT DOCUMENTS

| | | | |
|---|---|---|---|
| FR | 915378 | A | * 11/1946 |
| FR | 2650371 | A | * 2/1991 |

OTHER PUBLICATIONS

Webster's New Riverside University Dictionary © 1984, p. 503.*

* cited by examiner

*Primary Examiner*—Josiah C. Cocks
(74) *Attorney, Agent, or Firm*—Merchant & Gould P.C.

(57) ABSTRACT

A prefabricated fireplace assembly and method of manufacturing same are disclosed. The assembly is configured for direct mounting to the framework of a rough opening of a building in which it is to be installed. A prefabricated fireplace box having a combustion chamber for either wood or gas fireplaces, is connected to and carried by a surrounding framework of building materials, to provide a zero clearance fireplace module assembly. The framework forms a permanent part of the fireplace assembly and acts as a shipping container, protecting the fireplace box until the assembly is installed. After installation, the framework becomes an integral part of the wall or structure to which the assembly is mounted. External siding of the building and interior room sheetrock can be directly secured to the assembly framework, eliminating the need for additional contractor framing around the fireplace assembly.

18 Claims, 8 Drawing Sheets

FRAMED FIREPLACE AND METHOD

This application is a continuation of application Ser. No. 09/354,495, filed Jul. 16, 1999 now U.S. Pat. No. 6,374,822, application(s) are incorporated herein by reference.

RELATED APPLICATIONS

This application relates to copending U.S. application Ser. No. 09/024,285 filed on Jul. 6, 1999 entitled Low Cost Prefabricated Fireplace With Fiber Insulation Firebox and Ser. No. 08/538,866 filed on Jan. 19, 1996 entitled Universal Non-Porous Fiber Reinforced Combustion Chamber, and to U.S. Pat. No. 4,793,322 dated Dec. 27, 1988 entitled Direct-Vented Gas Fireplace, all of which are incorporated herein by reference.

FIELD OF THE INVENTION

This invention relates generally to prefabricated fireplaces, and more particularly to a prefabricated fireplace assembly that is peripherally framed with standard building materials for direct installation into a rough opening in a building.

BACKGROUND OF THE INVENTION

Whether for providing heat, for purely decorative purposes, or for value enhancement, fireplace assemblies have become commonplace in today's building trades for both residential and commercial applications. Most new home construction designs include at least one, and often several fireplaces. Further, a significant number of remodeling projects are focused about fireplace assemblies.

Such popularity is in great measure due to the development of direct vented fireplace assemblies, of the type generally described in U.S. Pat. No. 4,793,322. By eliminating the need for a conventional chimney, the direct vented fireplace assembly not only drastically reduces the cost of installing a fireplace, but also significantly increases the architectural design flexibility for such units, since the fireplace assemblies can now be designed in numerous configurations and can be readily positioned virtually anywhere in a room or building. More recent use of light weight reinforced ceramic fiber materials and binders has enabled fireplace fireboxes and combustion chambers to be constructed with the appearance of traditional masonry fireplaces, while exhibiting superior insulating properties that enables such assemblies to be installed with minimal separation spacing from surrounding building materials. The cross-referenced copending patent applications U.S. Ser. Nos. 09/024,285 and 08/538,866 describe such fireplace construction techniques and are herein incorporated by reference to the extent that their disclosures are useful or necessary for understanding and/or supporting this invention.

Heretofore, fireplace assemblies of the type that are inserted into a wall have generally required the contractor to not only frame in an enclosure for receiving the assembly, but to also prefinish that enclosure with sheetrock or other appropriate fire-grade material, prior to installation of the fireplace assembly. Further, the fireplace assemblies inserted into such enclosures typically include a metal protective outer shroud material. Such construction processes and fireplace construction both increase the overall cost of the project.

The present invention addresses the above short comings of prior fireplace assemblies and installation requirements.

The present invention provides a novel fireplace assembly construction that eliminates the need for contractor construction of prefinished receptor enclosures, as well as the need for costly outer sheet metal fireplace assembly shrouds and provides other benefits to the installing contractor.

SUMMARY OF THE INVENTION

The present invention incorporated the most desirable features and advantages of prior fireplace assembly designs, while reducing the costs of both the fireplace assembly and its preinstallation construction labor and materials. The present invention provides a fireplace assembly that requires only a rough opening in the wall in which the fireplace will be mounted, similar to that for a window or similar fenestration, for mounting the assembly. No labor intensive enclosure construction or prefinishing is required to contain the fireplace assembly. The assembly can simply be inserted into the presized rough opening and affixed thereto by brackets extending from the assembly, all during the framing phase of a building project.

The factory produced fireplace assembly is delivered to the jobsite with a preassembled external framework of building materials. The framework also serves as the shipping carton for the assembly. Once the contractor hangs the assembled unit in the rough opening, he can directly apply sheetrock or other interior wall materials up to the assembly at the same time that the interior walls of the building are being finished, and can directly apply external siding or other wall and/or roof canopy materials to or against the factory provided framework of the fireplace assembly. Contractor installation error is virtually eliminated, since proper safety and reliability concerns are addressed at the factory, not at the jobsite, by the preinstallation of surrounding framing members of known strengths and clearance tolerances to satisfy all structural, governmental and safety requirements for the fireplace assembly.

According to one aspect of the invention there is provided a prefabricated fireplace assembly, comprising: (a) a fireplace box defining a combustion chamber; and (b) a framework of building materials connected to operatively support the fireplace box, wherein the framework forms an integral part of the fireplace assembly that remains connected to the fireplace assembly when it is installed within the building structure. The framework assembly is of a configuration that can be directly mounted within a rough opening of a wall in a building structure by mounting flanges. According to a further aspect of the invention, the fireplace box preferably comprises a ceramic combustion chamber of molded construction and having a support flange integrally embedded within the ceramic for securing the fireplace box to the framework. According to yet a further aspect of the invention, the framework is configured to become a part of an external wall of the building structure in which the fireplace assembly is to be installed.

According to yet a further aspect of the invention there is provided a prefabricated fireplace assembly module of a type suitable for zero tolerance installation within a rough opening of a building framework, wherein heat generated by use of the fireplace assembly will not reach predetermined unsafe levels for the building framework, comprising: (a) an external framework of building materials of a type directly compatible and configured for mounting to the rough opening building framework; and (b) an open fireplace box fixedly mounted to and carried by said external framework and bordered by said external framework on at least three sides of said fireplace box.

According to yet a further aspect of the invention there is provided a method of manufacturing a prefabricated fireplace assembly comprising the steps of: (a) forming a fireplace box having a combustion chamber; (b) forming a framework of building materials about said fireplace box; and (c) mounting the fireplace box to the framework, wherein the fireplace box and framework collectively form a prefabricated fireplace assembly module.

While specific venting configurations will be illustrated in describing preferred embodiments of the invention, it will be understood by those skilled in the art that the invention is not to be limited to any particular vent configuration. As a matter of fact, the principles of the invention could apply equally well to a totally ventless firebox construction. Further, while the present invention will be illustrated with reference to several specific examples of framing configurations applied to the fireplace assembly, the particular framing configuration or shapes illustrated in the preferred embodiment is not intended to be limiting to the invention. Also, framing materials need not be applied to all sides of the fireplace, but need only apply to those sides of the fireplace that would be covered by finishing materials. For example a corner or three-sided fireplace unit would require less framing materials. It will also be appreciated that while the preferred embodiments of the invention have been described with respect to wooden framing building materials, the invention is not limited to the use of any particular type of building materials. For example, the wooden framing materials could be replaced by plastic or metal or other suitable building materials.

It will also be understood that while a gas energized assembly will be described with respect to the preferred embodiments, the invention is not limited to gas-fired units, but could equally apply to wood burning structures. Further, while the present invention will be described with respect to its use with a universal firebox of molded RFC material, the invention is not to be limited to any particular firebox material, but could be used with other known firebox construction such as those of sheet metal and other known materials. These and other modifications of the invention will be understood by those skilled in the art in view of the following description of the invention, with reference to specific preferred embodiments thereof.

BRIEF DESCRIPTION OF THE DRAWINGS

Referring to the figures, wherein like numerals represent like parts throughout the several views.

DETAILED DESCRIPTION OF THE PREFERRED EMBODIMENT

Figure 1:
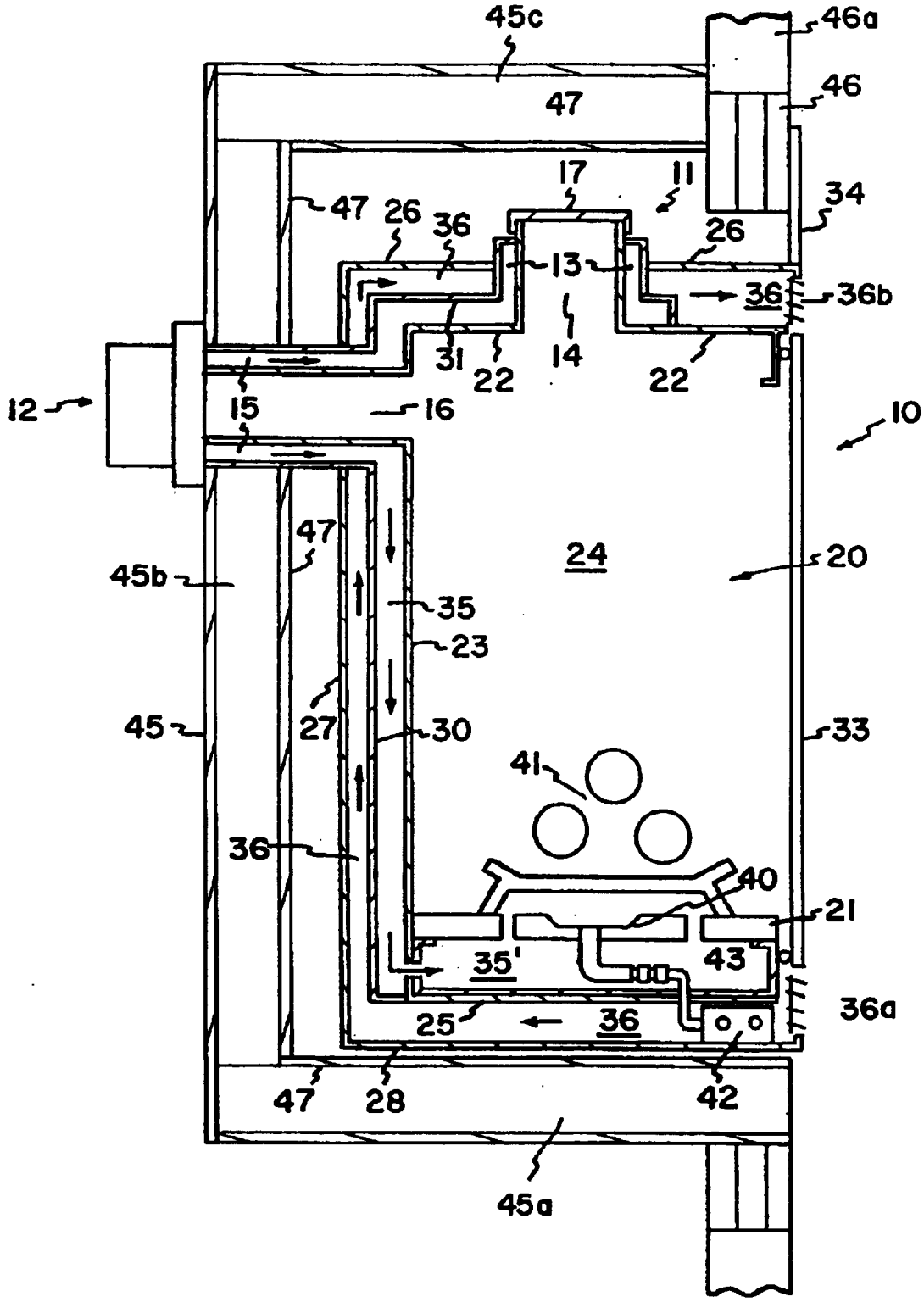
FIG. 1 PRIOR ART
FIG. 1 is a schematic cross-sectional drawing in side elevation of a prior art direct vented fireplace unit having a metal combustion chamber surrounded by an outer housing preformed from formed panels of sheet metal, and illustrated as it would appear as mounted in a typical enclosure.

The present invention can be better understood by first referring to conventional prior art techniques for installing a fireplace assembly into an enclosure. FIG. 1 illustrates a schematic drawing and side elevation of a convertible dual direct-vented fireplace of the type shown and described in U.S. Pat. No. 5,647,340, incorporated by reference. The fireplace 10 is illustrated as having a vertical venting means 11 and horizontal venting means 12. For purposes of this description, the term venting means 11 or 12 refers to the fresh air vent 13 and to the exhaust stack 14 which form the vertical venting means 11, or to the similarly functioning elements 15 and 16 of the horizontal venting means 12. The fireplace 10 is of a type prefabricated from sheet metal and is further provided with a fabricated cap 17 for sealing one of the two venting means 11 and 12. As illustrated in FIG. 1, the vent 11 is sealed by the cap 17, in a manner well-known in the art.

In the FIG. 1 fireplace assembly, the combustion chamber is indicated at 20 and is generally defined by a lower panel 21, and upper panel 22, a rear panel 23, and oppositely disposed side panels 24. The lower floor of the combustion chamber is illustrated at 25. The outer surround of the fireplace assembly is defined by an upper panel 26, a rear panel 27, a lower panel 28, and oppositely disposed side panels (not illustrated) which collectively surround the combustion chamber and form a protective outer surround layer or shroud for the fireplace assembly. An intermediate back wall 30 is interposed between the rear panel 23 of the combustion chamber and the back panel 27, and an upper intermediate wall 31 is interposed between the upper panel 22 of the combustion chamber and the upper surround panel 26. Fresh air vents 13 and 15 connect to the passageways formed between upper walls 22 and 31 and between rear walls 23 and 30, forming a fresh combustion air plenum 35 that extends downward and connects to a fresh combustion air passageway 35' (illustrated as extending under lower panel 21), and which could extend directly into the combustion chamber proper 20. The spaces between lower walls 25 and 28, rear walls 27 and 30 and upper walls 26 and 31 collectively form a heat exchanger passageway 36 that receives room air at a lower inlet 36*a*, heats the air from the heat of the combustion chamber and directs the heated air back into the room through the upper outlet port 36*b*. An optional blower system (not illustrated) can be located within the heat exchange plenum 36 to facilitate movement of air through the heat exchanger 36 and into the room environment. A flat pan burner 40 is illustrated below a log system 41. The burner 40 is connected to a gas valve 42 by means of a flexible pipe 43 in manner well-known in the art, and as described in more detail U.S. Pat. No. 5,647,340. The front of the combustion chamber is closed by an appropriate door panel, generally indicated at 33. The vertical vent means 11 extends through the upper panel 22, and the horizontal vent means 12 extends through the rear-panel 23.

In the standard mounting configuration for such fireplaces as illustrated in FIG. 1, the fireplace assembly 10 is mounted within a framed enclosure 45 having lower wall framing members 45*a*, back wall framing members 45*b*, upper wall framing members 45*c*, and sidewall framing members (not illustrated). Such enclosures also typically have an upper header 46 horizontally extending over the upper portion of the enclosure and carried by studs 46*a* of the building structure. All of the inner surfaces of the framing members are enclosed by continuous wall members, generally indicated at 47, which typically comprise a fireproof material such as sheetrock. The outer surfaces of the framing members 45 are covered by appropriate external wall members, such as siding or the like, to the extent that such surfaces are exposed to external elements and the weather. The upper outer wall portion may be shaped in the form of a rough canopy or the like. The enclosure structure is typically fully constructed prior to insertion of the fireplace assembly 10 into the assembly. Decorative trim panels, such as indicated at 34 are typically attached to the assembly after installation to fill any gaps between the outer surround of the installed assembly and the inner periphery of the enclosure.

The typical prior art techniques for installing fireplace assemblies, either entirely or partially, within walls of a building or structure generally requires that the enclosure into which the fireplace assembly is to be installed, be framed and pre-finished prior to installation of the fireplace assembly. This practice means that the fireplace assembly is one of the latest installations to be made in the construction process. Besides the costs involved with the pre-installation framing and completion of the fireplace enclosure, the fireplace assembly if preordered, is often in the way of and vulnerable to damage by construction workers during the sheetrocking and other labor intensive operations. The present invention eliminates these issues by providing a fireplace assembly that is configured to become and to be installed as a part of the initial structure framing process. Since the fireplace assembly is installed early on in the process, it is not in the way where it may be damaged during the sheetrocking and other finishing processes.

The principles of this invention can be applied to virtually any type of pre-fabricated fireplace assembly that is to be installed either wholly or partially within a wall of a structure. For example, the inventive principles can be applied to the direct vented type of fireplace illustrated at 10 in FIG. 1. However, the cost advantages attainable by use of the present invention are best realized by using a fireplace having a fireplace box made of highly insulative materials such as reinforced fiber ceramic material (RFC). The superior insulating properties of such materials enable fabrication of a fireplace assembly for zero clearance applications, that does not require the expense of a surrounding protective shroud of the type formed by the panels 26, 27 and 28 of the FIG. 1 fireplace assembly.

Figure 2:
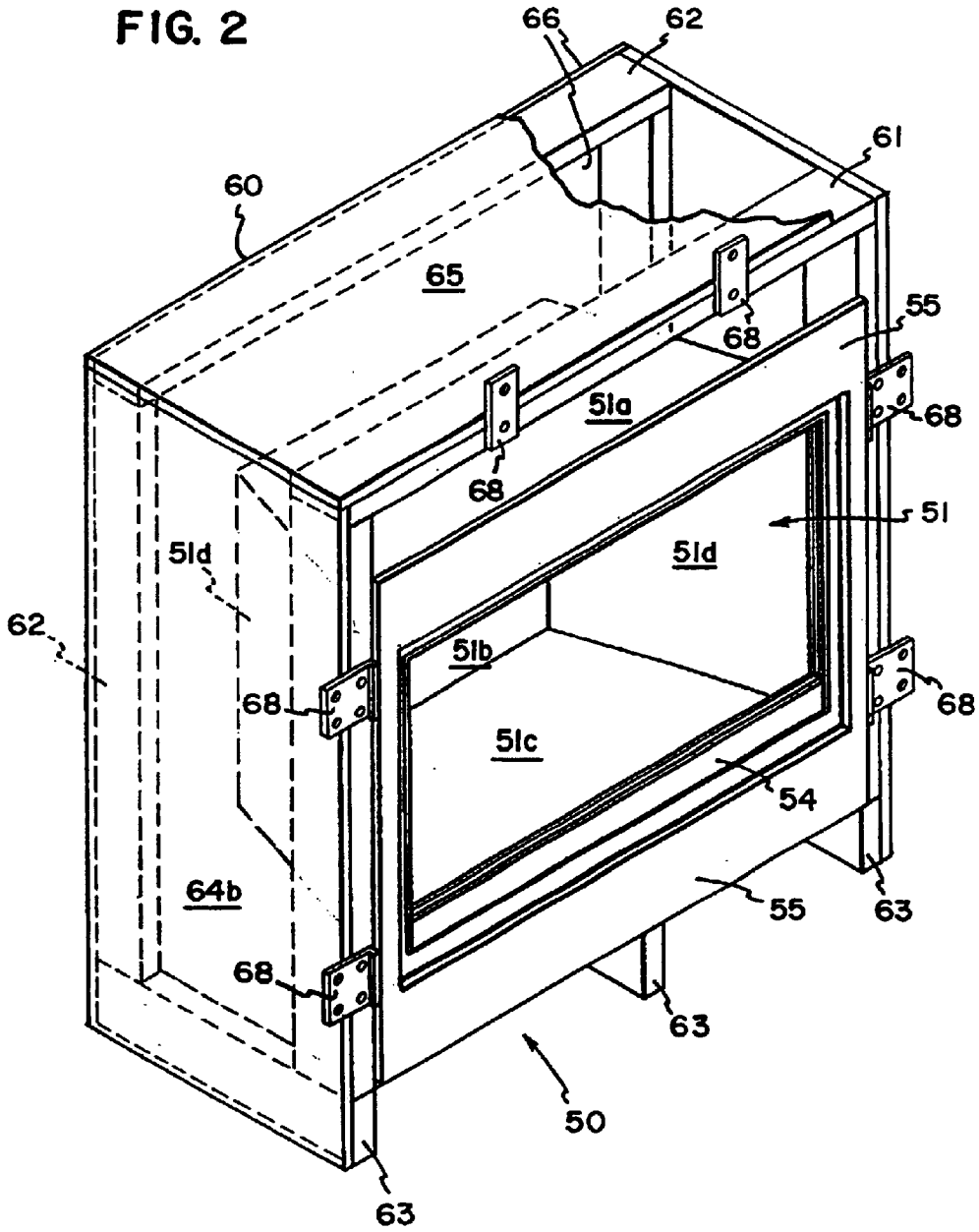
FIG. 2 is a perspective schematic drawing of a first embodiment of a fireplace assembly incorporating the principles of this invention, illustrating a universal fireplace box and an external peripheral framing structure.
Figure 3:
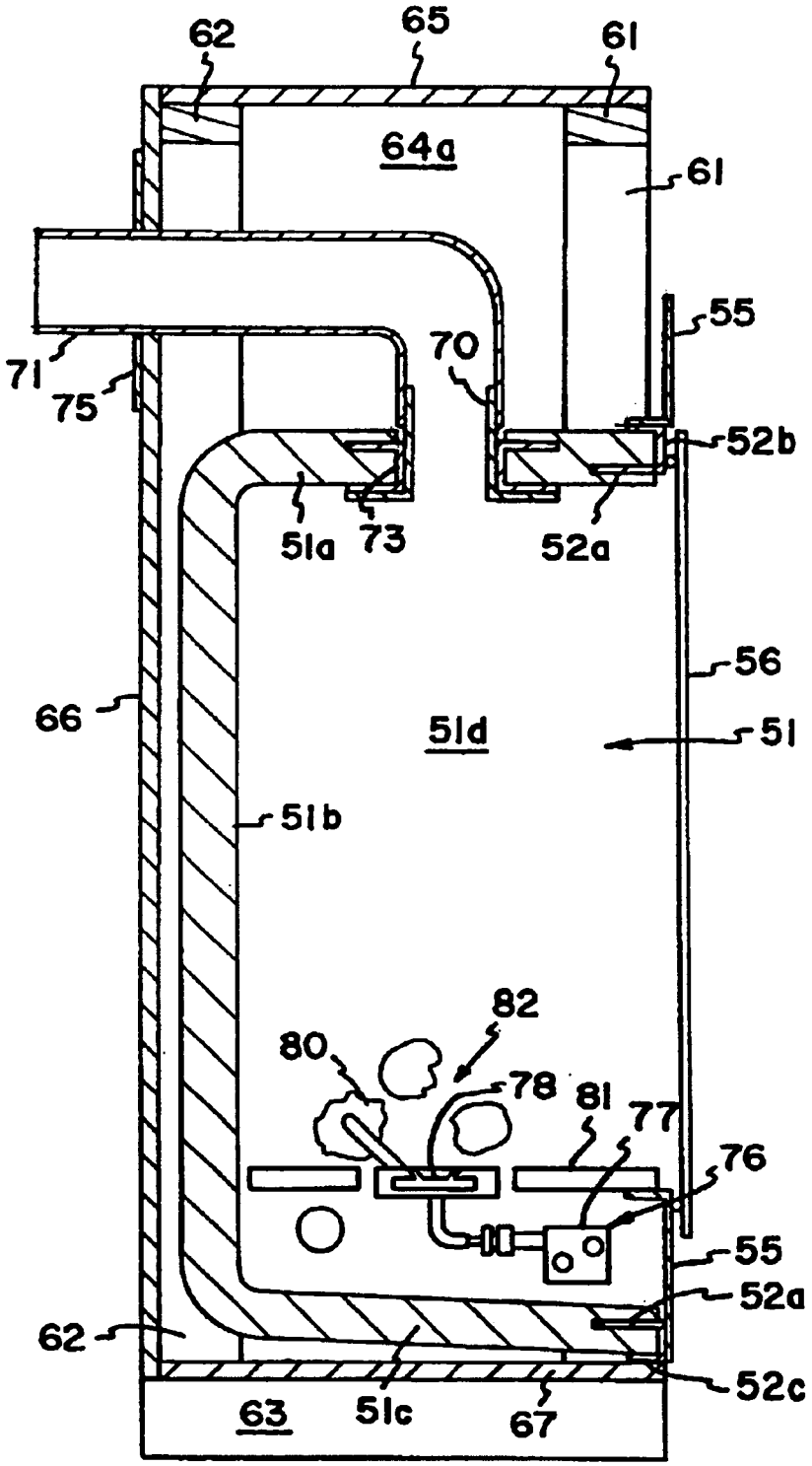
FIG. 3 is a schematic cross-sectional drawing, in side elevation of the fireplace assembly of FIG. 2, generally taken along the Line 3—3 in FIG. 2, incorporating a self purging horizontal direct vent exhaust feature.
Figure 4:
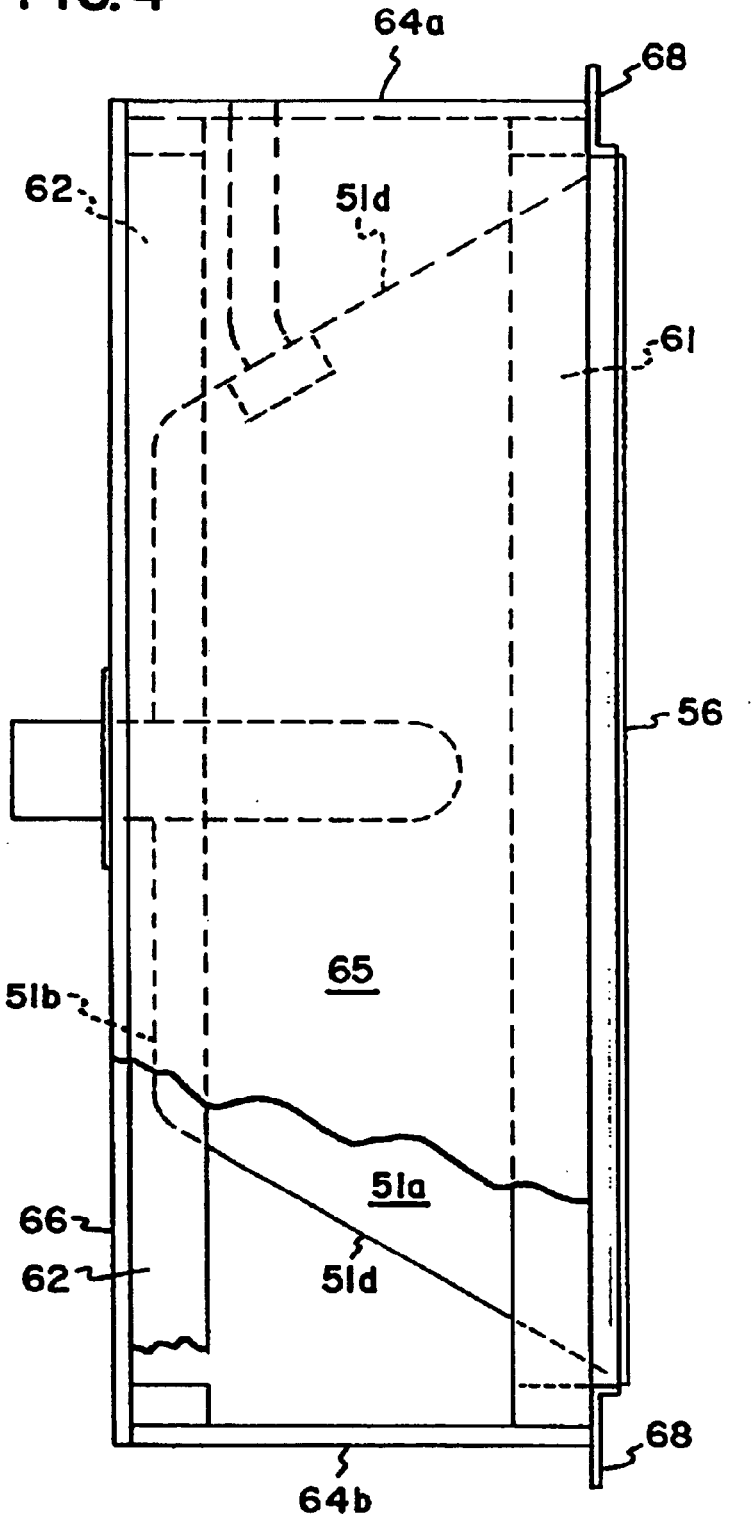
FIG. 4 is a schematic fractional top view drawing of the fireplace assembly of FIG. 3.
Figure 5:
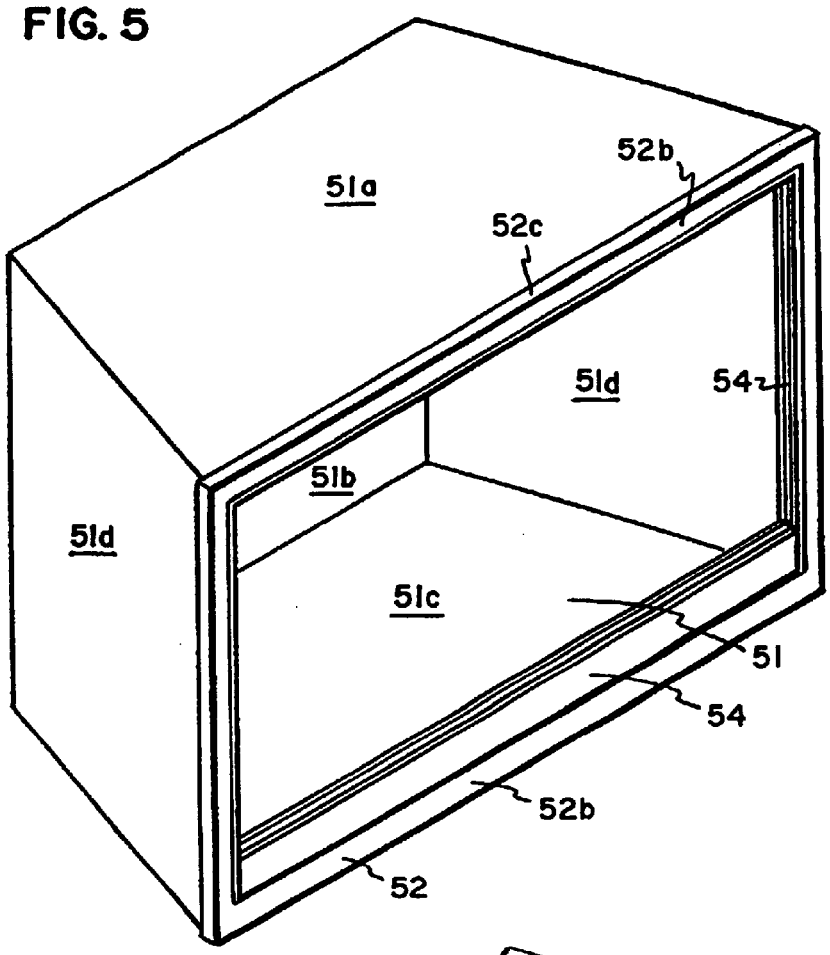
FIG. 5 is a perspective view of the firebox portion of the fireplace assembly of FIG. 2.
Figure 6:
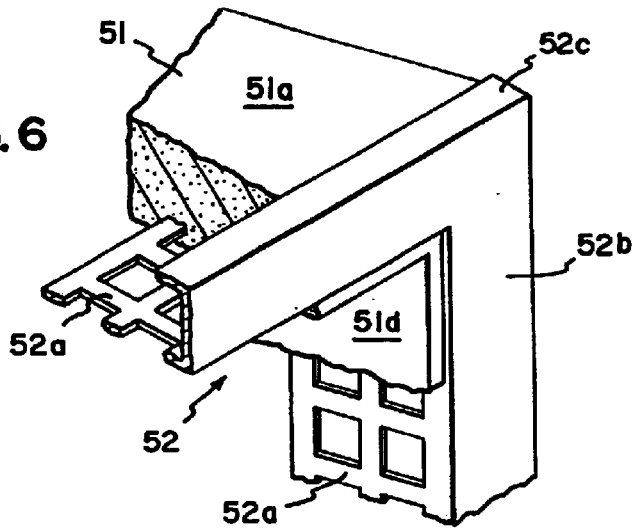
FIG. 6 is an enlarged fractional view of a corner portion of the firebox of FIG. 5, illustrating the manner in which the front edge bracket thereof is embedded within the firebox wall.

A first embodiment of a fireplace assembly 50 incorporating the principles of this invention and utilizing a universal fireplace box 51 of RFC material is illustrated in FIGS. 2–4. The fireplace box 51 is preferably an open ended ceramic fireplace box that is of molded or cast construction as described in copending patent applications U.S. Ser. Nos. 09/024,285 and 08/538,866. To the extent that a more detailed description of the configuration or construction of such ceramic materials is desired, the reader is referred to the referenced patent applications, the disclosures of which are fully herein incorporated by reference. The fireplace box 51, which is illustrated by itself in FIG. 5, generally has an upper wall portion 51*a*, a rear wall portion 51*b*, a bottom wall portion 51*c* and opposed sidewall portions 51*d*, integrally molded together to form a one-piece fireplace box construction. The walls of the fireplace box are generally about one and a half to two inches thick. A U-shaped collar flange 52 peripherally extends around the entire rectangular front edge of the fireplace box 51. The collar flange construction is illustrated in more detail in FIG. 6. The flange is preferably configured of cold rolled steel with a galvanized/aluminized coating. Referring thereto, in the preferred embodiment, the flange has a first leg member 52*a*, approximately two inches long, that is embedded within the ceramic body through its distal end, and is molded into the ceramic. The first leg member is perforated to enable passage of the ceramic molding material therethrough and to enhance securement of the flange to the fireplace box during molding of the box. The plane of the first leg member 52*a* is embedded into the front end of the fireplace box around its entire periphery at a spaced distance of approximately one half inch back from the inner surfaces of the fireplace box at the front edge. A central portion 52*b* of the collar flange lies generally co-planar with and engages the front edge of the fireplace box around its entire periphery, and forms a decorative edge for the fireplace box. A second leg portion 52*c* of the collar flange completes the U-shaped bracket and extends back from the decorative front portion 52*b* along the outer surface of the fireplace box for a distance of approximately one and a half inches, and serves as a fastener base member (as hereinafter described) for securing other portions of the fireplace assembly to the fireplace box.

An inner trim frame 54 may be peripherally secured to the collar bracket 52 for supporting an operable door within the fireplace box opening. Alternatively, since the U-shaped bracket 52 forms a seal with the combustion chamber of the fireplace box due to its integral construction therewith, the glass door panel may be directly secured and sealed to the front planar portions 52*b* of the U-shaped bracket or to extension thereof. Referring to FIG. 2, a decorative surround front panel 55 is secured by screws to the outer fastener leg portions 52*c* of the U-shaped collar flange, which serves as a mounting base therefore. A glass door panel 56 is schematically illustrated as mounted to the front surfaces of the decorative front panel 55.

An outer framework of building materials, generally illustrated at 60, is secured to the fireplace assembly. In the first embodiment illustrated in FIGS. 2–4, the framework 60 includes first and second rectangular 2×4 board frame members 61 and 62, respectively located adjacent the front and the rear of the fireplace assembly. The front frame member 61 is secured through the surround panel 55 to the U-shaped collar flange 52. The rectangular frames are longitudinally spaced from one another in the axial direction of the fireplace box, and are secured to one another by means of a plurality of lower 2×4 board stringers 63 designed to support the fireplace assembly upon a floor or other planar surface by means of a bottom side panel 67 and a plurality of lower 2×4 board stringers 63. The stringers 63 are appropriately laterally spaced from one another to enable tines of a forklift to be inserted therebetween for moving the fireplace assembly during shipping and handling. The lower surface of the bottom wall 51*c* of the fireplace box 51 is inclined at a slight angle in the direction from front to back of the fireplace box 51, as illustrated in FIG. 3. The frames 61 and 62 are also interconnected by means of oppositely disposed side panels 64*a* and 64*b*, and by an upper panel 65. The back of the framework assembly of the first embodiment is closed by a back panel 66. A plurality of brackets, generally indicated at 68 are secured to the front rectangular frame portion 61 at various positions therealong for mounting the fireplace assembly 50 to a rough opening framework of the structure in which the fireplace assembly is to be installed.

The framework serves multiple purposes. It acts as a packaging or shipping container for the fireplace assembly, protecting the fireplace box and assembly in general from damage during shipment and handling, and at the construction site. The entire fireplace assembly, framework included, is mounted by means of the peripheral support brackets 68 to the building framework that defines the rough opening for the fireplace assembly, in much the same manner that a window unit or other type of fenestration product is secured to its rough opening. As mounted to the rough opening, the framework 60, which is connected to the fireplace box 51, supports the fireplace box in its mounted position within the rough opening in the wall. Referring to FIG. 3, it will be noted that the upper decorative panel 55 is spaced from the front surfaces of the support frame 61 by a distance which allows a panel of sheetrock to be inserted therebetween. The sheetrock is secured directly to the framing member 61, which becomes a framing member portion of the wall of the structure in which the fireplace assembly is installed. Similarly, the back panel 66 and the side panels 64 of the framework form a portion of the external structure of the wall, to which external siding or the like can be directly applied. It will be appreciated that the tolerances between the outer surfaces of the fireplace box 51 and the inner surfaces of the surrounding framework 60 are appropriately spaced from one another to provide a safety margin for preventing overheating of the surrounding framework assembly. The particular spacing between the fireplace box and surrounding framework will be dictated by the use to which the fireplace assembly is put (i.e. whether it is a relatively low btu unit used for decorative purposes, or a relatively high btu unit used for heating purposes). Since the framework assembly is designed and applied to the fireplace assembly at the factory, where such tolerances and safety factors can be accurately controlled, jobsite contractor error in this regard is eliminated.

Referring to the schematic drawing and side elevation of FIG. 3, the fireplace assembly illustrated is one of a type referred to as a self purging direct vent fireplace having the open-ended firebox 51 which is shown having a large opening in its upper wall 51*a* for receiving an exhaust collar 70 therethrough which connects to an exhaust pipe 71. The exhaust collar 70 is sealably connected to the upper wall 51*a* of the fireplace box 51 by a U-shaped collar flange 73 that is integrally embedded within the ceramic material of the upper wall 51*a* at the time of molding of the fireplace box, and is of generally the same construction of the U-shaped collar flange 52, previously described. A second exhaust flange 75 supports the exhaust pipe 71 for safe exit through an opening in the rear wall 66 of the framework 60. Near the bottom portion of sidewall 51*d*, there is another aperture, generally designated by the letter "A" at 74 which is used for supplying combustion air to the burner system of the fireplace assembly. It will be appreciated that the fresh air aperture "A" could be located in either the side or back walls of the fireplace box.

A burner system, schematically illustrated at 76 can be of any type well-known in the art, and is preferably one which includes a gas valve 77 mounted on an appropriate pan or panel (not illustrated) and connected to a flat pan or other type of burner, generally indicated at 78 by means of a tubing assembly 79. The burner is preferably of a type having a ceramic top that is formed as a bed of coals or burn wood and is shown in detail and described in U.S. Pat. No. 5,601,073 which issued on Feb. 11, 1997. As illustrated in FIG. 3, a hollow log burner 80 is also connected to the flat pan burner. The log system and burner 80 are preferably supported on a removable floor panel, generally indicated at 81 which has cutouts and apertures for fitting over the flat pan burner 78, while offering support for the log system 82. It will be appreciated that the entire burner and floor assembly can be readily removed from the fireplace box 51 for shipping purposes and can be readily installed within the fireplace box and connected to an appropriate supply of gas at the time of installation of the system.

Figure 7:
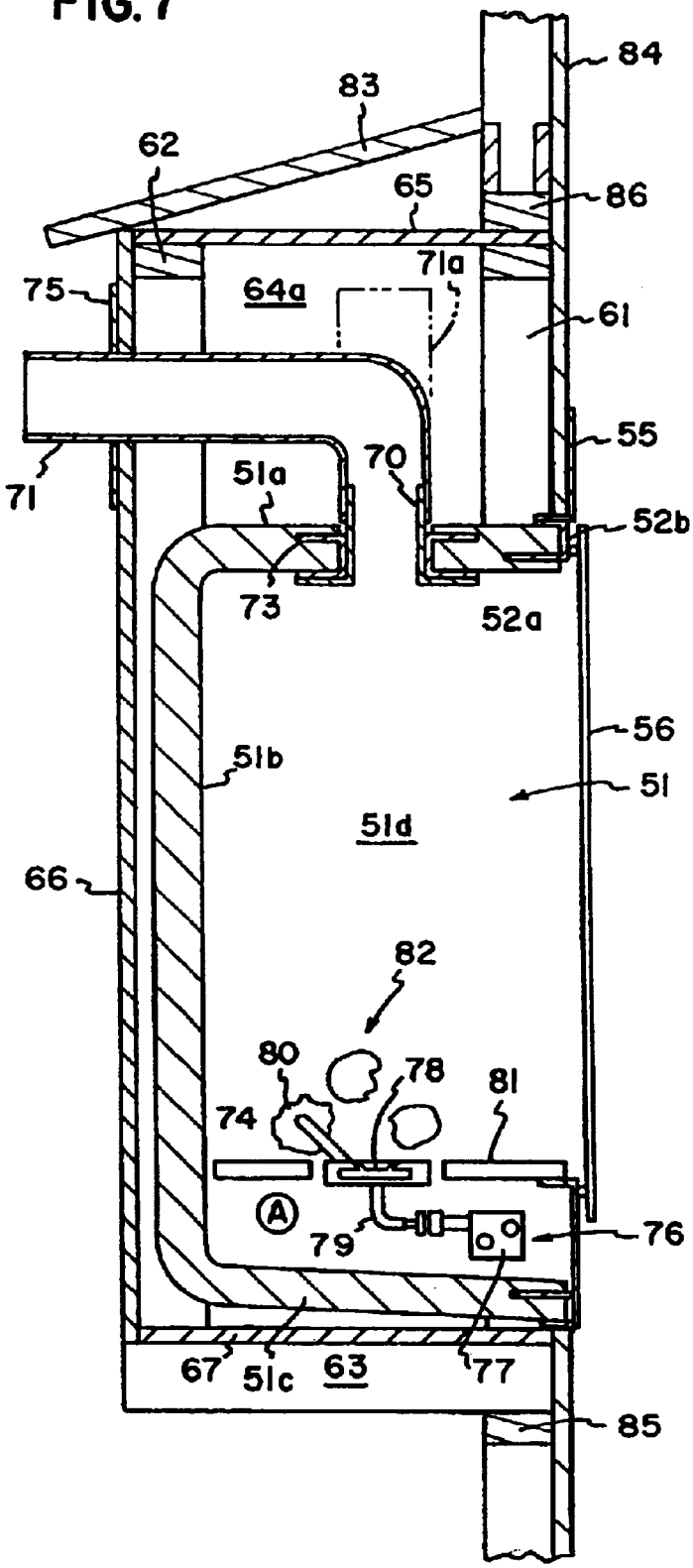
FIG. 7 is a schematic drawing illustrating the fireplace assembly of FIG. 3, mounted in a rough opening of a structure and illustrating an overlying protective roof canopy mounted to the assembly.

Referring to FIG. 7, the fireplace assembly of FIG. 3 is illustrated as it would be mounted within a rough opening of a structure. The lower stringers 63 of the framework structure of the fireplace assembly lie upon and are supported by a lower stud member 85 defining the lower extremity of the rough opening. The fireplace assembly is then leveled within the rough opening and secured in its leveled position to the side and top frame members of the rough opening by means of the plurality of mounting brackets or flanges 68. An upper header portion of the rough opening is generally indicated at 86. A canopy roof, generally indicated at 83 is illustrated as having been connected between the upper stud members of the wall and the back portion of the framework of the fireplace assembly. External siding or the like can be directly applied to the rear wall 66 and to the sidewalls 64 of the framework structure. Similarly, a layer of sheetrock, generally indicated at 84 is illustrated as being secured to both the upper header framing 86 and to the front frame member 61 of the fireplace assembly. The phantom lines at 71*a* indicate that the exhaust pipe could also have been directed upwardly through the upper wall of the fireplace assembly, rather than through the backwall.

Figure 8:
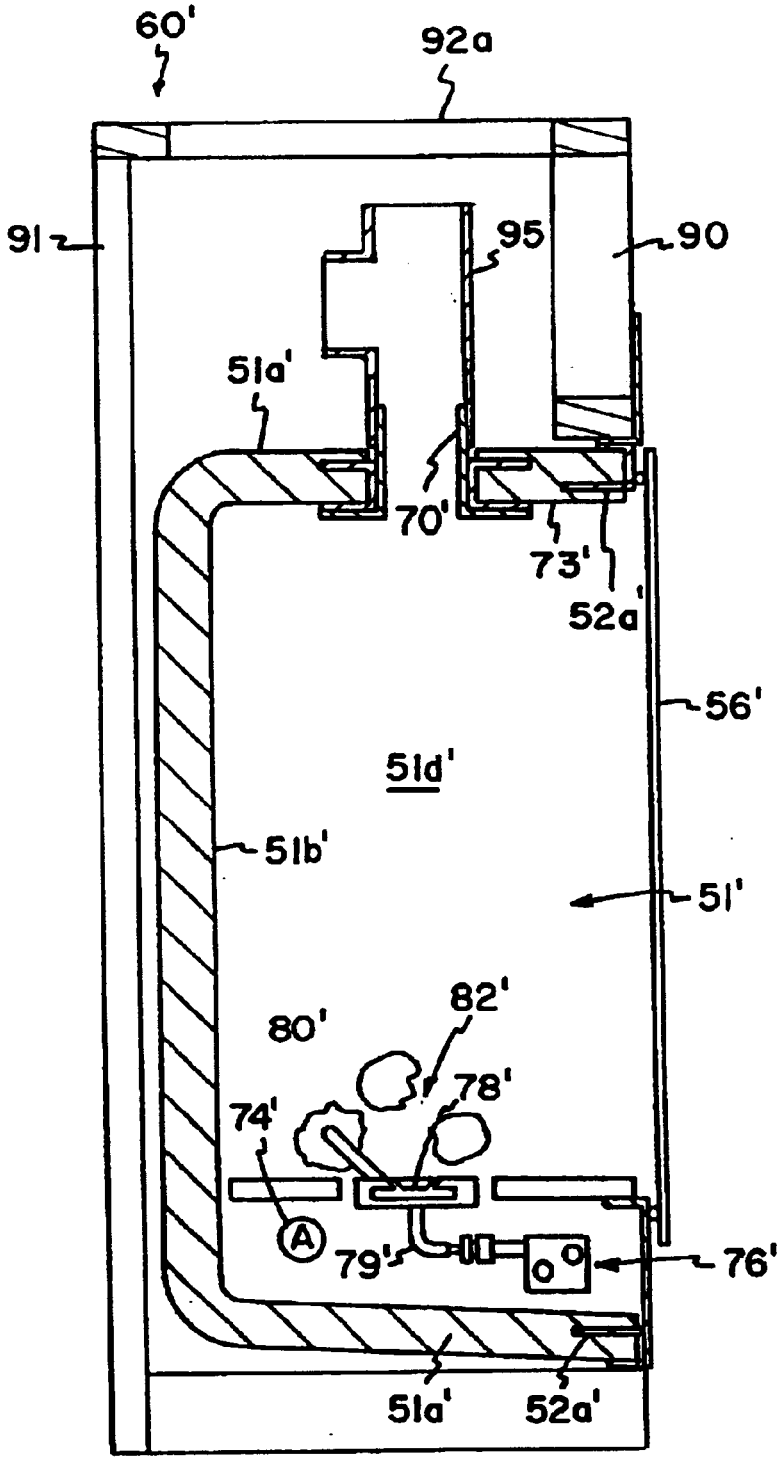
FIG. 8 is a schematic cross-sectional side elevation drawing of a second embodiment of a fireplace assembly incorporating the present invention and incorporating a self-purging universal horizontal/vertical exhaust vent.
Figure 9:
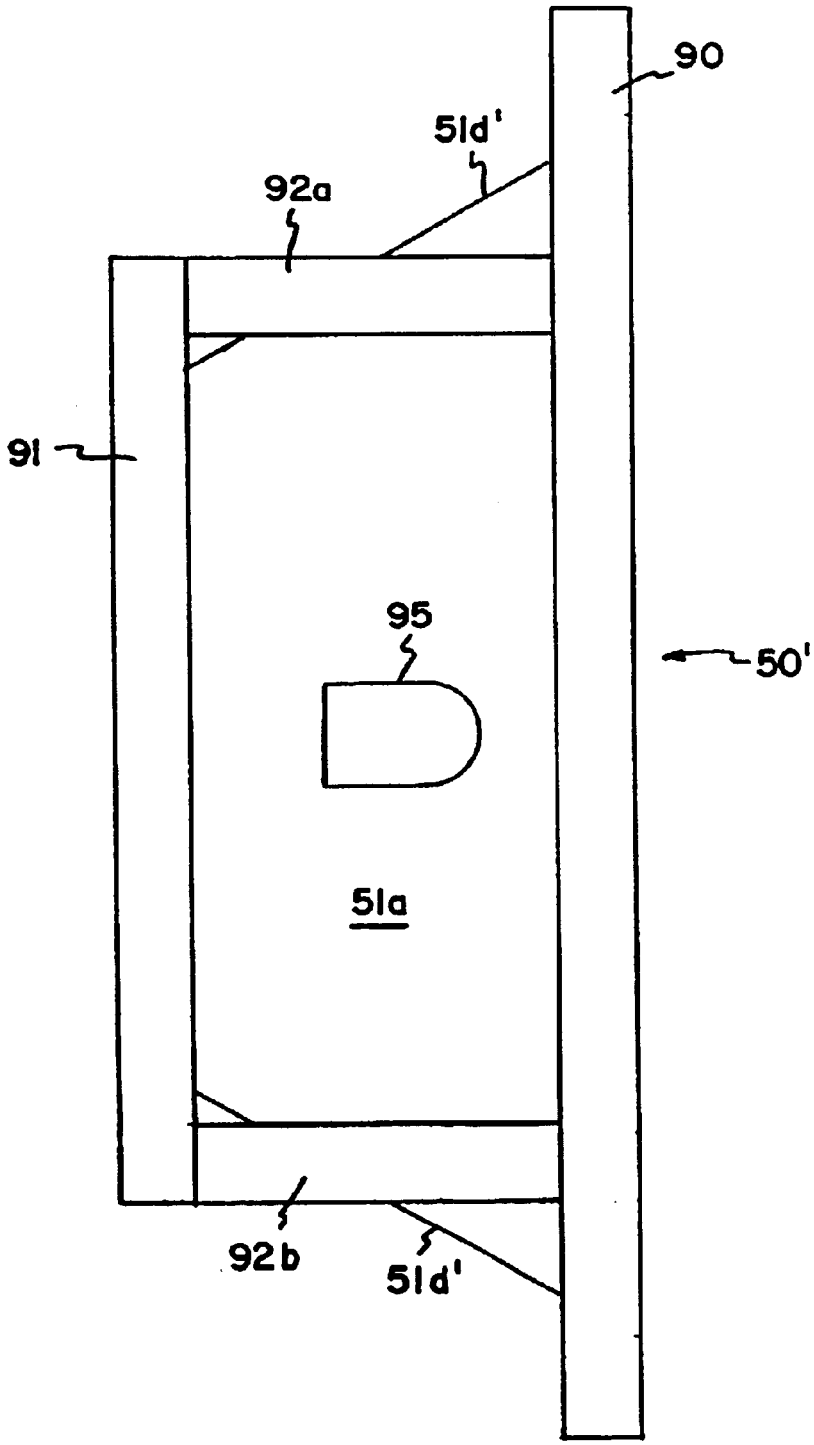
FIG. 9 is a schematic top elevation drawing of the fireplace assembly of FIG. 8.

It will be appreciated that many different types of surrounding framework structures can be configured within the spirit and intent of this invention. An example of an "open" framework structure, simply configured from 2×4 boards with no external sheathing or panels, is illustrated in FIGS. 8 and 9. Referring thereto, the same internal fireplace box and burner assemblies previously described with respect to FIGS. 2–6 are illustrated, wherein the numerical designations of like numbered parts have been followed by a prime designation. The "open" framework configuration 60 prime of a type that may, for example, be used wherein the fireplace assembly is being inserted into an internal wall of a structure, where there is no need for a rear or side support structure for external siding or the like, or for situations wherein a customized enclosure is going to be built for the fireplace assembly. The framework 60' simply includes an upper 2×4 material frame portion 90 connected to a rear rectangular frame 91 by means of several upper connecting frame members 92*a* and 92*b*, and by several lower interconnecting frame members 93. While the framework 60' is of open construction, its framing members are still spaced along the perimeter of and slightly beyond the outer surfaces of the fireplace box, to protect the box from injury during shipping and handling thereof. The fireplace assembly of FIGS. 8 and 9 is illustrated with a convertible exhaust outlet 95 for optional exhaust venting in either a horizontal or vertical manner.

Thus, those skilled in the art will appreciate that a fireplace assembly of unique construction and use has been disclosed. Those skilled in the art will appreciate that other variations of the invention from those specific preferred embodiments described can be configured within the broad spirit and scope of this invention. For example, while the preferred embodiments of the invention that have been described were described with reference to use of an external framing structure in association with a highly insulative ceramic fireplace box, the invention would also apply to prefabricated fireplace boxes of sheet metal construction such as illustrated by the direct vented fireplace assembly of FIG. 1. In such instances, additional insulation would most likely be required to be placed between the outer surrounding shroud of the fireplace assembly and the framing components to insulate the framing components from heat transmitted from the metal components of the fireplace box.

The above specification, and examples have been provided to illustrate specific examples of embodiments incorporating the principles of the invention. Those skilled in the art will readily recognize other applications and configurations that fall within the scope of this invention. Since many embodiments of the invention can be made without departing from the spirit and scope of the invention, the invention resides in the claims hereinafter appended.

What is claimed is:

1. A pre-framed fireplace assembly for installation in a structure, the pre-framed fireplace assembly comprising:

(a) a fireplace comprising a one-piece fireplace box including a molded ceramic material, wherein a support flange is embedded within said molded ceramic material; and (b) a framework of building materials including a plurality of frame members attached to the fireplace, wherein the fireplace and framework together define a standalone structure prior to introduction into the structure, wherein the framework and fireplace are configured to be mounted as a single unit within a pre-sized opening of the structure, and wherein the framework is operatively connected to the support flange.

2. The pre-framed fireplace assembly of claim 1, wherein the building materials comprise non-cementitious building materials.

3. The pre-framed fireplace assembly of claim 1, wherein the fireplace comprises a direct vent fireplace.

4. The pre-framed fireplace assembly of claim 1, wherein the framework is of a configuration that is directly mountable within the framed opening of the structure.

5. The pre-framed fireplace assembly of claim 1, wherein a building framework defines the framed opening.

6. The pre-framed fireplace assembly of claim 1, wherein the framework is configured to form part of a wall of the structure in which the pre-framed fireplace assembly is to be installed.

7. The pre-framed fireplace assembly of claim 6, wherein the wall is an external wall of the structure.

8. The pre-framed fireplace assembly of claim 1, wherein the framework comprises wooden building materials.

9. The pre-framed fireplace assembly of claim 1, wherein the framework acts as a shipping container for the fireplace assembly.

10. A method for installing a pre-framed fireplace assembly into a structure, the method comprising the steps of:

(a) manufacturing a fireplace;

(b) forming a framework of building materials about the fireplace, the framework including a plurality of frame members;

(c) attaching the framework to the fireplace during manufacture of the fireplace, wherein the fireplace and framework collectively form the pre-framed fireplace assembly;

(d) thereafter, shipping the pre-framed fireplace assembly to an installation location; and (e) installing the pre-framed fireplace assembly within a pre-sized opening of the structure at the installation location, wherein the framework is not provided within the pre-sized opening of the structure prior to introduction of the pre-framed fireplace.

11. The method of claim 10, wherein the fireplace assembly forms a portion of a wall of the structure.

12. The method of claim 10, wherein the fireplace comprises a direct vent fireplace.

13. The method of claim 10, wherein the step of manufacturing the fireplace comprises the step of molding the fireplace as a ceramic one-piece fireplace box.

14. The method of claim 13, further comprising the step of embedding a support flange within the ceramic one-piece fireplace box for connection to the framework.

15. The method of claim 10, further comprising the step of attaching the framework of building materials to a building framework, wherein the building framework defines the framed opening of the structure.

16. The method of claim 10, wherein the framework forms a container that protects the fireplace from damage.

17. The method of claim 10, wherein the building materials comprise non-cementitious building materials.

18. The method of claim 10, wherein said framework comprises wooden building materials.

* * * * *